US007478550B2

(12) United States Patent
Wynn et al.

(10) Patent No.: US 7,478,550 B2
(45) Date of Patent: Jan. 20, 2009

(54) SHELL PRESS AND METHOD FOR FORMING A SHELL

(75) Inventors: David Keith Wynn, Tipp City, OH (US); Steven Todd Albright, Covington, OH (US)

(73) Assignee: Stolle Machinery Company, LLC, Centennnial, CO (US)

( * ) Notice: Subject to any disclaimer, the term of this patent is extended or adjusted under 35 U.S.C. 154(b) by 0 days.

(21) Appl. No.: 11/655,602

(22) Filed: Jan. 19, 2007

(65) Prior Publication Data

US 2008/0173058 A1 Jul. 24, 2008

(51) Int. Cl.
*B21D 22/00* (2006.01)
*B21D 51/44* (2006.01)

(52) U.S. Cl. ..... 72/348; 72/347; 413/56

(58) Field of Classification Search ..... 72/34, 72/347–349; 413/56, 62
See application file for complete search history.

(56) References Cited

U.S. PATENT DOCUMENTS 1,672,044 A * 6/1928 Stanek ..... 72/396
4,955,223 A 9/1990 Stodd et al.
5,042,284 A 8/1991 Stodd et al.
5,309,749 A 5/1994 Stodd
5,502,995 A 4/1996 Stodd
5,634,366 A 6/1997 Stodd
5,857,374 A * 1/1999 Stodd ..... 72/348
7,143,623 B1 * 12/2006 Turnbull et al. ..... 72/348
2006/0010953 A1 * 1/2006 Turner et al. ..... 72/348

* cited by examiner

*Primary Examiner*—Dana Ross
*Assistant Examiner*—Debra M Sullivan
(74) *Attorney, Agent, or Firm*—Grant E. Coffield; Eckert Seamans Cherin & Mellott, LLC

(57) ABSTRACT

The invention generally relates to an apparatus for forming a shell. The apparatus has a die center and a panel punch located in opposed relation to the die center. A panel punch piston is coupled to the panel punch. The panel punch piston has an upper end and a spacer member is disposed concentrically around an outside surface of the panel punch piston at or proximate to the upper end of the panel punch piston. The upper end of the spacer member is in contact with a lower end of the panel punch and the spacer member is located proximate to a peripheral surface of the lower end of the panel punch. A method for manufacturing a shell is additionally provided as well.

20 Claims, 14 Drawing Sheets

SHELL PRESS AND METHOD FOR FORMING A SHELL

FIELD OF THE INVENTION

The invention generally relates to an apparatus and method for forming container end panels, commonly called shells, from a sheet of blanked material.

BACKGROUND OF THE INVENTION

The forming of can ends or shells for can bodies, namely aluminum or steel cans, is well-known in the art. Shells typically have a center panel connected to an inner panel wall which is connected to a countersink. The countersink is connected to a chuck wall of the shell which is connected to a crown. The crown is connected to a peripheral curl that is structured to be seamed onto a can body.

A problem that exists in prior art tooling assemblies occurs in those situations where an end user has to make an adjustment to the press ram because the heat in the die set causes the tooling to grow which, in turn, causes the shell unit depth to be too deep and out of specification. Oftentimes, the end user has to make a number of press ram adjustments to maintain the shell dimensions at specification until the temperature in the die set stabilizes. These types of adjustments in a high speed shell manufacturing line is both impractical and causes lost production.

In order to eliminate the need for press ram adjustments, a number of end users will adjust the press shutheight to provide a shell unit depth dimension at a low limit of the specification. As the press is stabilized at operating temperatures, the shell will grow in unit depth dimension to a high limit of the specification. Such a practice produces a shell that meets end user specifications, but other processes of the shell manufacturing process is negatively affected, such as, for example, conveying the shells, accumulating the shells and bagging the converted ends. Also, as the product reaches the high limit of the shell unit depth specification, the amount of material in the curl is reduced and this could adversely affect seaming of the final converted can ends onto a can body.

As a press and its associated tooling assemblies reach operating temperatures, expansion of the tooling assemblies change the product dimensions. A die core ring in the lower tooling is coupled to a die retainer coupled to the lower die shoe. The positioning of the die core ring provides for the upper end of the die core ring, which is unrestrained, to axially expand upward. A die center coupled to a die center riser is provided in the upper die shoe. The die center is used to penetrate into the die core ring a fixed distance to provide for a specified shell unit depth. The change in the height of the upper end of the die core ring to a face of the die center causes the shell unit depth of the product to become deeper. This variation in shell unit depth is caused by thermal expansion of the die core ring.

Due to the potentially high internal pressures generated by carbonated beverages, both the can body and the can end are typically required to sustain internal pressures of 90 psi (0.621 MPa) without cracking or deformation. Depending on various environmental conditions such as heat, over fill, high carbon dioxide content, and vibration, the internal pressure in a beverage may exceed internal pressures of 90 psi (0.621 MPa). Recently, shell developments have been focused on engineering various features of the shell including the chuck wall angle in order to reduce the metal content in the shell, but still provide the shell with the capability of sustaining internal pressures exceeding 90 psi (0.621 MPa). Another approach to reducing metal content in the shell is to use reduced gauge metal sheet in the manufacture of the shell. The reduced metal content in the shell makes it desirable for the shells to have dimensions that are centered within the specifications of the end user in order to prevent, for example, rupture and catastrophic failure of the shell. As end users continue to strive to reduce the metal content in shells and improve manufacturing processes, end users desire an apparatus and method for forming shells with a generally uniform depth without the complications of adjusting the press ram, the press shutheight or the like throughout their day-to-day operations.

As a result, a need exists in the art for a shell press and method for forming shells that manufactures shells having a unit depth that centers the dimensions of the shells within the specifications of the end user.

Another need exists in the art for an apparatus and method for forming shells having a uniform unit depth.

SUMMARY OF THE INVENTION

An object of the invention is to provide an apparatus and method for forming shells that manufactures shells having a unit depth that centers the dimensions of the shells within the specifications of the end user.

Another object of the invention is to provide an apparatus and method for forming shells having a uniform unit depth.

Certain objects of the invention are achieved by providing a tooling assembly for forming a shell. The tooling assembly has a die center and a panel punch located in opposed relation to the die center. A panel punch piston is coupled to the panel punch. The panel punch piston has an upper end and a spacer member is disposed concentrically around an outside surface of the panel punch piston at or proximate to the upper end of the panel punch piston. The upper end of the spacer member is in contact with a lower end of the panel punch and the spacer member is located proximate to a peripheral surface of the lower end of the panel punch.

Other objects of the invention are achieved by providing an apparatus for forming a shell. The apparatus has a die center and an upper pressure sleeve located proximate to the die center. A blank and draw die is located proximate to the upper pressure sleeve. A panel punch is located in opposed relation to the die center. A die core ring having an upper end has the upper end of the die core ring located proximate to the panel punch and in opposed relation to a lower end of the upper pressure sleeve. A lower pressure sleeve having an upper end has the upper end of the lower pressure sleeve located proximate to the die core ring and in opposed relation to a lower end of the blank and draw die. A blank cutedge is located proximate to the lower pressure sleeve. A panel punch piston is coupled to the panel punch. The panel punch piston has an upper end and a spacer member is disposed concentrically around an outside surface of the panel punch piston at or proximate to the upper end of the panel punch piston. An upper end of the spacer member is in contact with a lower end of the panel punch and the spacer member is located proximate to a peripheral surface of the lower end of the panel punch.

Other objects of the invention are achieved by providing a method for forming a shell. The method comprises: moving material between an upper die shoe and a lower die shoe; blanking the material to form a blank; forming the blank to provide a peripheral edge portion coupled to a raised center panel portion with the raised central panel portion located above the peripheral edge portion; forming the blank into a shell with a center panel coupled to a crown with the crown located above the center panel location; controlling movement of a panel punch by spacing the movement of the panel punch from a shoulder of a die core ring; and preventing engagement of a lower end of the panel punch with the shoulder of the die core ring.

DESCRIPTION OF THE PREFERRED EMBODIMENTS

Figure 1:
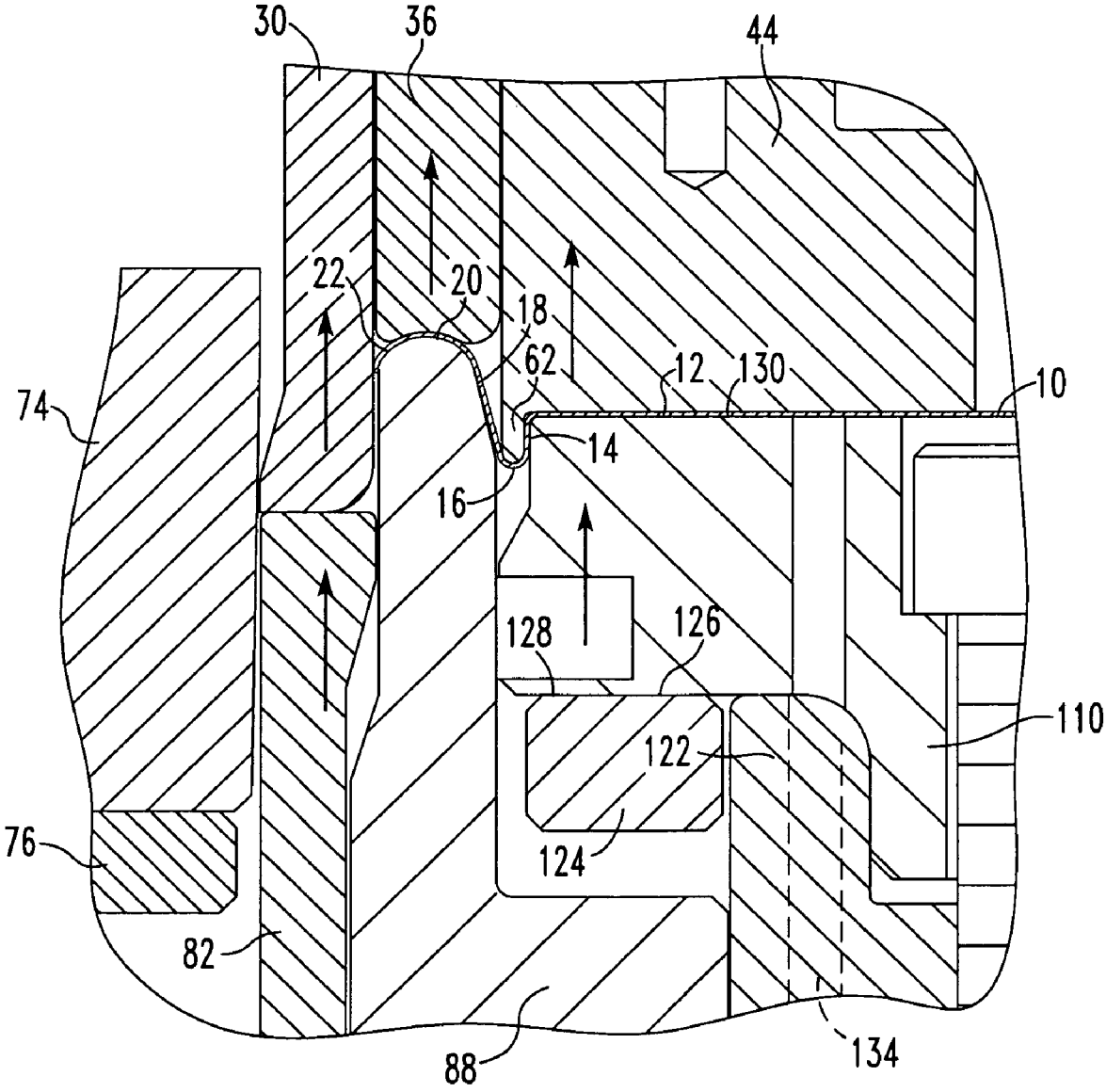
FIG. 1 is a cross-sectional view of a tooling assembly displaying a shell made in accordance with the invention.

For purposes of the description hereinafter, the terms "upper", "lower", "vertical", "horizontal", "axial", "top", "bottom", "aft", "behind", and derivatives thereof shall relate to the invention as it is oriented in the drawing FIGS. or as it is oriented when it is coupled to an upright can body that is resting on a flat and level horizontal surface. However, it is to be understood that the invention may assume various alternative configurations when the invention is moved about or the can body, for example, is resting in a dispensing machine in a horizontal relationship. It is also to be understood that the specific elements illustrated in the FIGS. and described in the following specification are simply exemplary embodiments of the invention. Therefore, specific dimensions, orientations and other physical characteristics related to the embodiments disclosed herein are not to be considered limiting.

As used herein, the term "fastener" means any suitable fastening, connecting or tightening mechanism such as dowel pins, fasteners, rivets, screws and the like. As employed herein, the term "number" shall mean one or to an integer greater than one (i.e., a plurality). As employed herein, the statement that two or more parts are "attached", "connected", "coupled", or "engaged" together shall mean that the parts are joined together either directly or joined through one or more intermediate parts.

Turning to FIG. 1, FIG. 1 shows a shell 10 which is typically formed from aluminum alloyed sheet or steel alloyed sheet. The shell 10 includes a circular center panel 12 which is connected by a substantially cylindrical panel wall 14 to an annular countersink 16 having a U-shaped cross-sectional configuration. A tapered annular chuck wall 18 connects the countersink 16 to a crown 20, and a peripheral curl 22 depends from the crown 20.

Figure 2:
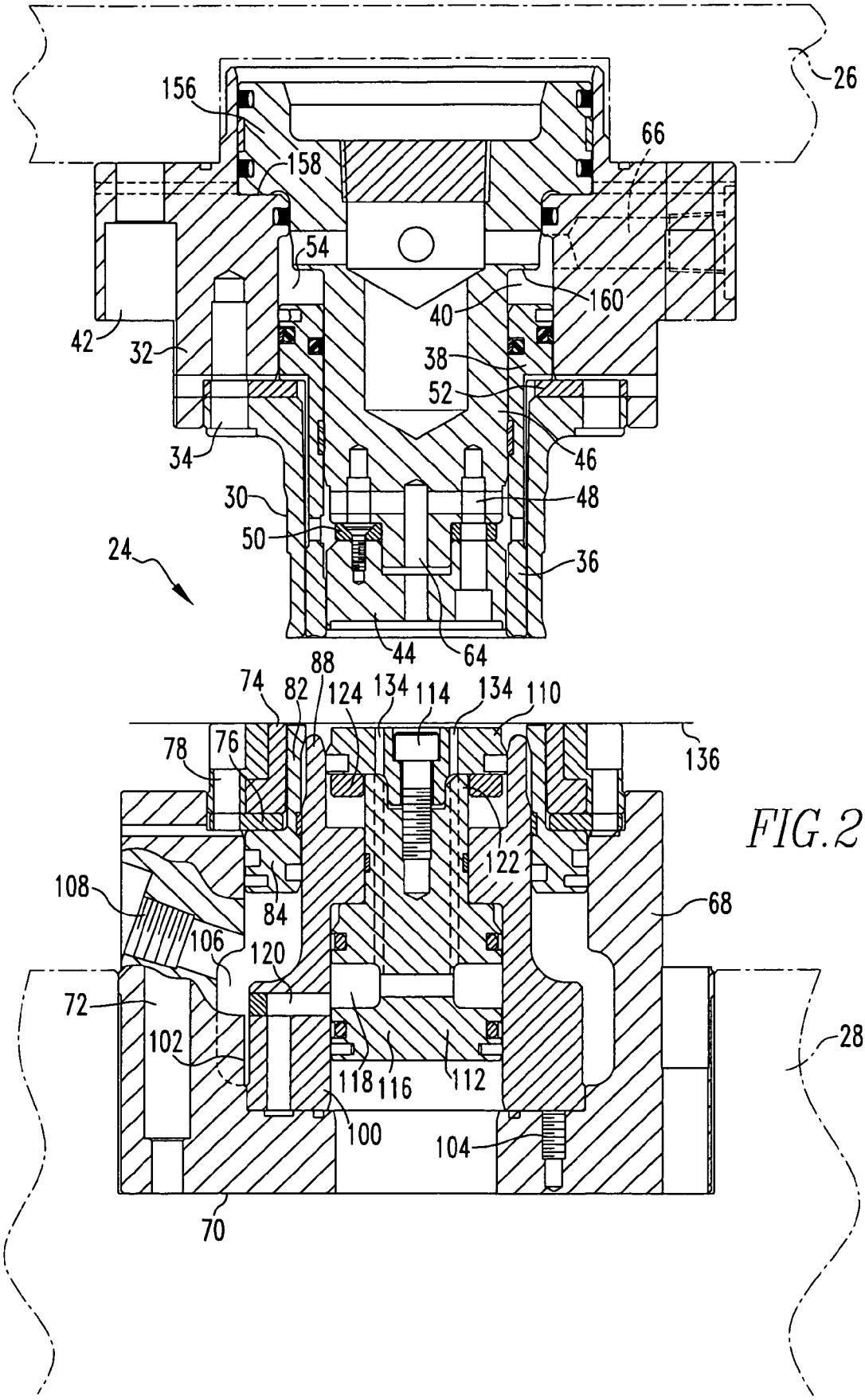
FIG. 2 is a cross-sectional view of a tooling assembly of the invention displayed coupled to a press.

FIG. 2 illustrates a single station of a multiple station tooling assembly 24 coupled to a press, for example, a 22 out tooling system. One shell 10 is produced at each station during each stroke of a conventional high speed single action or double action mechanical press to which the multiple station tooling assembly 24 of the invention is coupled. The tooling assembly 24 is coupled to an upper die shoe 26 and a lower die shoe 28 which are supported by the press bed and/or bolster plates and the ram within the press. An annular blank and draw die 30 has an upper flange portion coupled to a retainer or riser body 32 by a set of peripherally spaced fasteners 34, and the blank and draw die 30 surrounds an upper pressure sleeve 36. The blank and draw die 30 is located proximate to the upper pressure sleeve 36 and is located radially outward from the upper pressure sleeve 36. The upper pressure sleeve 36 has an upper piston portion 38 slidably supported within a chamber 40 defined within the riser body 32. A set of fasteners 42 couple the riser body 32 to the upper die shoe 26. An inner die member or die center 44 is supported within the upper pressure sleeve 36 by a cylindrical die center riser 46. The upper pressure sleeve 36 is located proximate to the die center 44 and is located radially outward from the die center 44. A set of fasteners 48 secure the die center 44 to the die center riser 46, and a flat annular spacer 50 is positioned between the die center 44 and the die center riser 46. Another annular spacer 52 is located between the blank and draw die 30 and the riser body 32 and forms a bottom stop for the upper piston portion 38. A passage within the riser body 32 directs low pressure gas of about 20 psi to 40 psi (0.138 MPa to 0.276 MPa) through passages 54 within the riser body 32.

Figure 3:
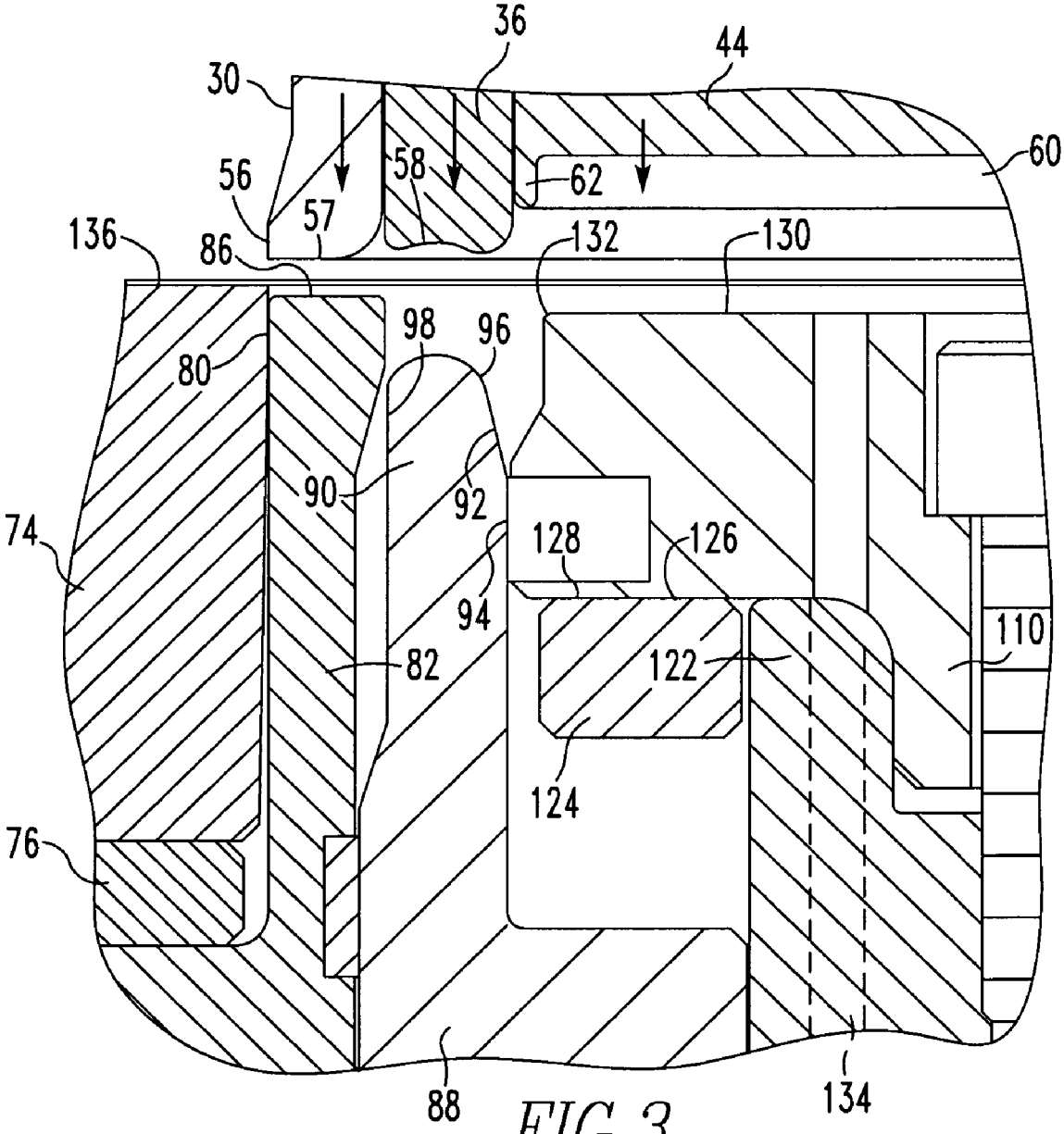
FIGS. 3-13 are cross-sectional views of FIG. 2 illustrating the progressive steps for manufacturing a shell in accordance with the invention.

As shown in FIG. 3, the blank and draw die 30 has a cylindrical lower cutting edge 56 and an inner curved forming surface 57. The lower end of the upper pressure sleeve 36 has a contoured annular forming surface 58, and the lower end of the die center 44 has a circular recess or cavity 60 defined by an annular projection or nose portion 62. The projection 62 has a curved bottom surface with a radius preferably between 0.015 inch (0.038 cm) and 0.020 inch (0.051 cm). As shown in FIG. 2, a center axially extending passage 64 is formed within the center of the die center 44 is a vent for the die center 44.

An annular die retainer 68 is coupled to the lower die shoe 28 within a circular counterbore 70 and is coupled to the lower die shoe 28 by circumferentially spaced fasteners 72. An annular cut edge die 74 with a hardened insert is attached with a spacer or washer 76 to the retainer 68 by peripherally spaced fasteners 78 and has an inner cylindrical cutting edge 80 (FIG. 3) with substantially the same diameter as the cutting edge 56 on the blank and draw die 30. An annular lower pressure sleeve 82 includes a lower piston portion 84 (FIG. 2) supported for sliding movement within the die retainer 68, and the lower pressure sleeve 82 has an upper end 86 (FIG. 3) that has a flat surface which opposes the lower end of the blank and draw die 30. The cut edge die 74 is located proximate to the lower pressure sleeve 82 and radially outward from the upper end 86 of the lower pressure sleeve 82.

A die core ring 88 is positioned within the lower pressure sleeve 82 and has an upper end 90 (FIG. 3) which opposes the lower end or forming surface 58 of the upper pressure sleeve 36. The upper end 90 has an inner frusto-conical or tapered surface 92 extending to a cylindrical surface 94, an inner rounded surface 96 and an outer rounded surface 98. The upper end 86 of the lower pressure sleeve 82 is located proximate to the upper end 90 of the die core ring 88 and the upper end 86 of the lower pressure sleeve 82 is located radially outward from the upper end 90 of the die core ring 88. The die core ring 88 also has a base portion 100 (FIG. 3) which is received within a counterbore or recess 102 formed within the die retainer 68. The base portion 100 is coupled to the die retainer 68 by circumferentially spaced fasteners 104. An annular chamber 106 is defined within the die retainer 68 around the die core ring 88 for receiving the lower piston portion 84 of the lower pressure sleeve 82. Low pressure gas of about 40 psi (0.276 MPa) is supplied to the annular chamber 106 through a passage 108 connected to a gas supply line.

A circular panel punch 110 (FIG. 2) is positioned within the die core ring 88 and is coupled to a panel punch piston 112 by a set of fasteners 114. The panel punch 110 is located in opposed relation to the die center 44. The upper end 90 of the die core ring 88 is located proximate to the panel punch 110 and the upper end portion 90 of the die core ring 88 is located radially outward from an upper end portion of the panel punch 110. The panel punch piston 112 is supported for axial movement within the die core ring 88. The lower end 116 of the piston 112 has a chamber 118 within the piston 112. Low pressure gas, on the order of 5 psi to 10 psi (0.034 MPa to 0.069 MPa) is supplied to the chamber 118 through a laterally extending passage 120 within the die core ring 88. The low pressure gas is structured to assist in shell 10 removal. A high pressure gas supply passage (not shown), on the order of 400 psi (2.758 MPa), also extends within the lower die shoe 28 and through the die retainer 68 below the panel punch piston 112. An upper end 122 of the piston 112 has a spacer member 124 disposed concentrically around the outside surface of the piston 112. The spacer member 124 may be located at or proximate to the upper end 122 of the piston 112. The spacer member 124 is a rigid member and could be made, for example, from tool steel, hardened metal, hardened plastic or other hardened materials. An upper end 126 of the spacer member 124 is in contact with a lower end 128 of the panel punch 110. The spacer member 124 is located proximate to a peripheral surface of the lower end 128 of the panel punch 110.

Referring to FIG. 3, the panel punch 110 has a circular flat upper surface 130 which extends to a peripheral surface 132 having a small panel radius of about 0.013 inch (0.033 cm) or less. The panel punch 110 also has circumferentially spaced and axially extending passages 134 (FIG. 2) which extend into the chamber 118 within the panel punch piston 112.

Figure 4:
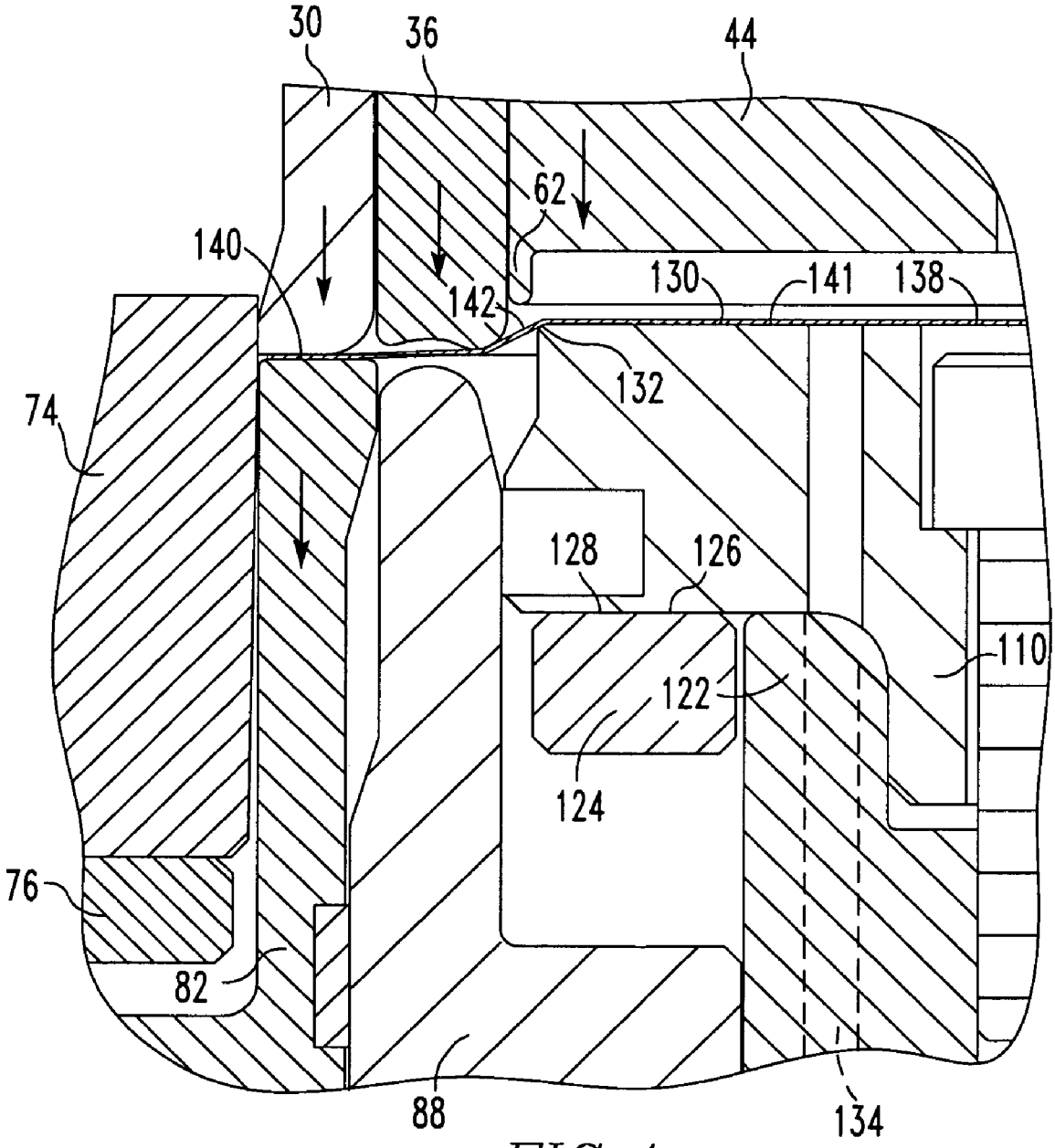
Figure 5:
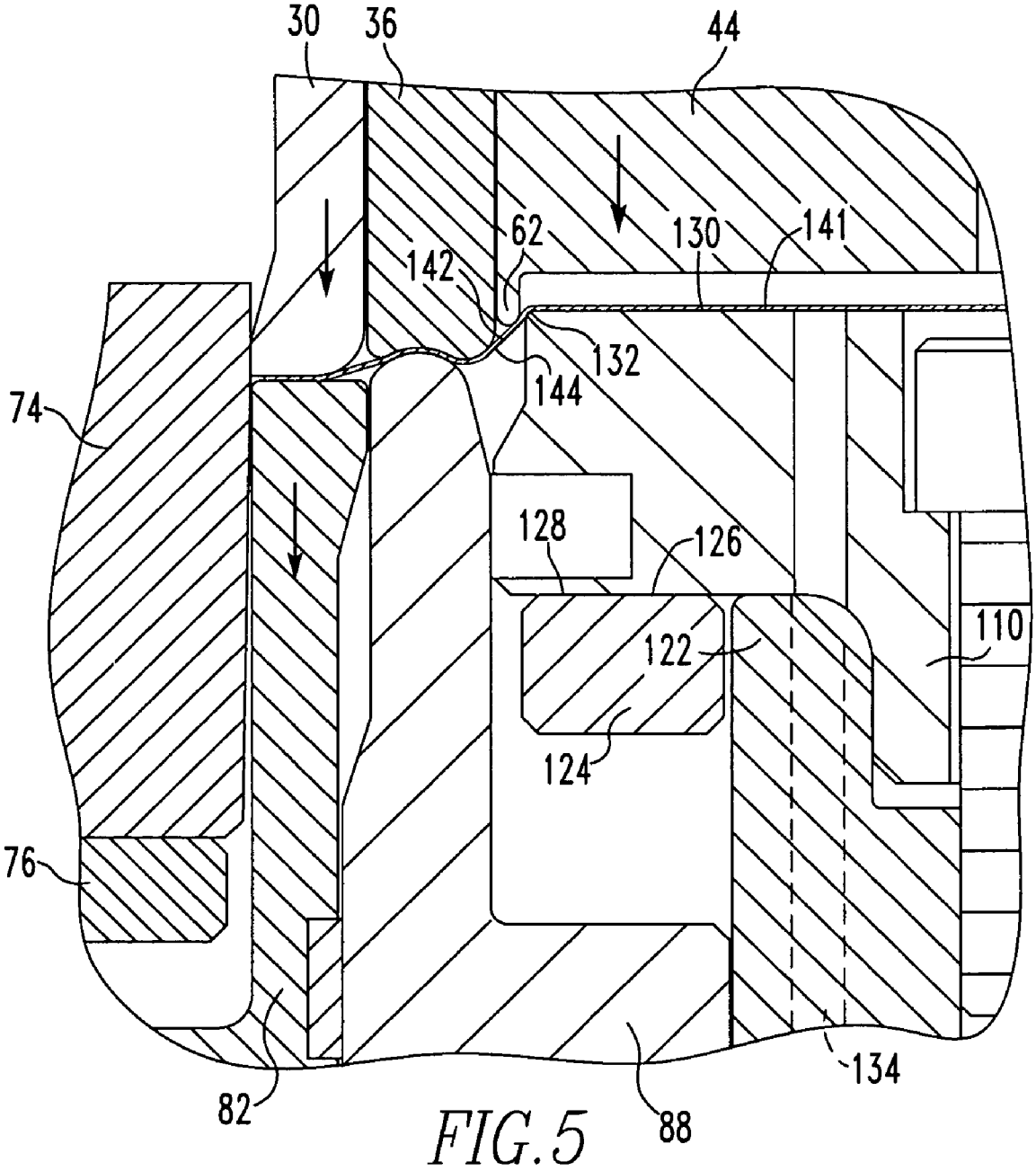
Figure 6:
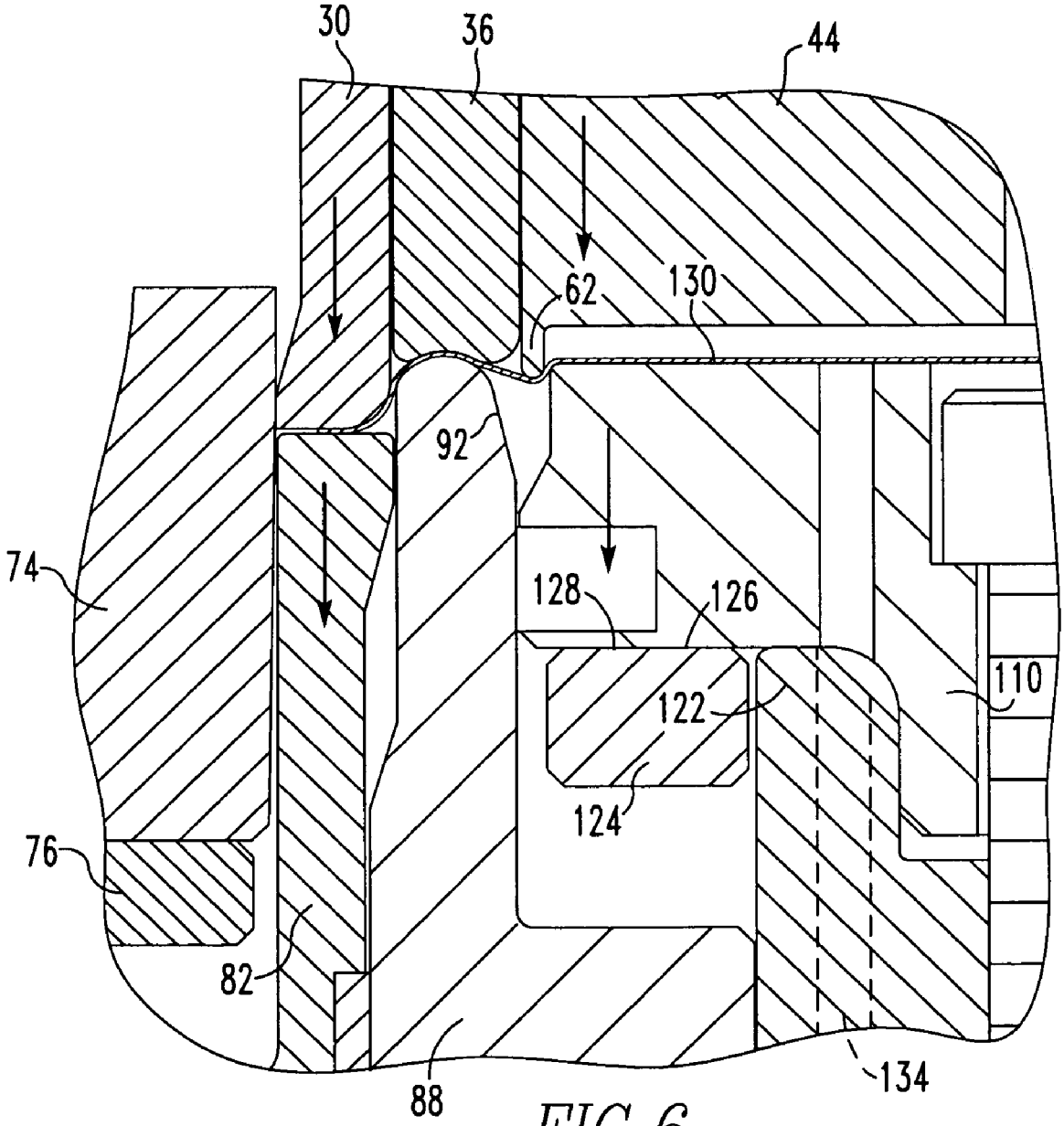
Figure 7:
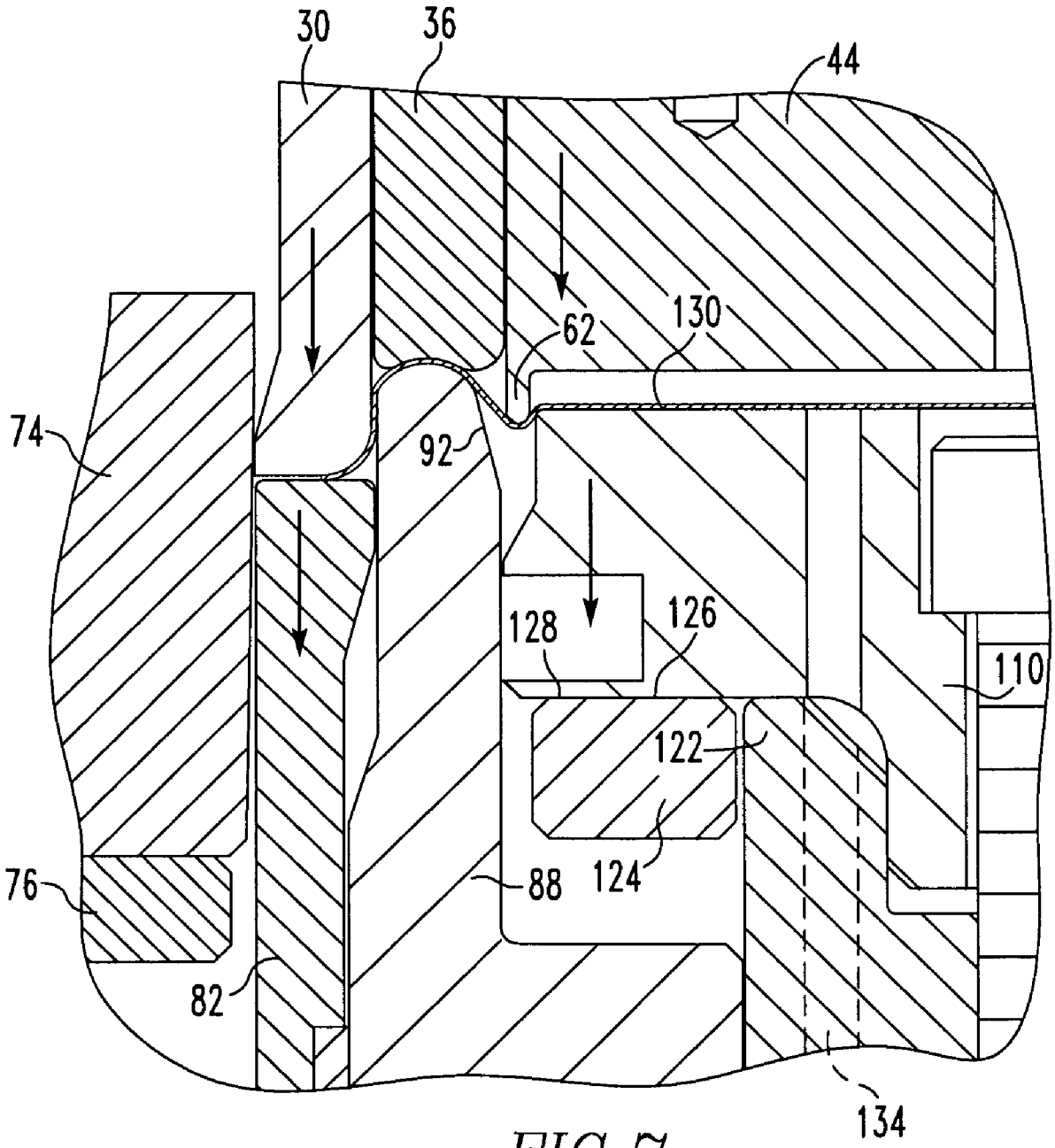
Figure 8:
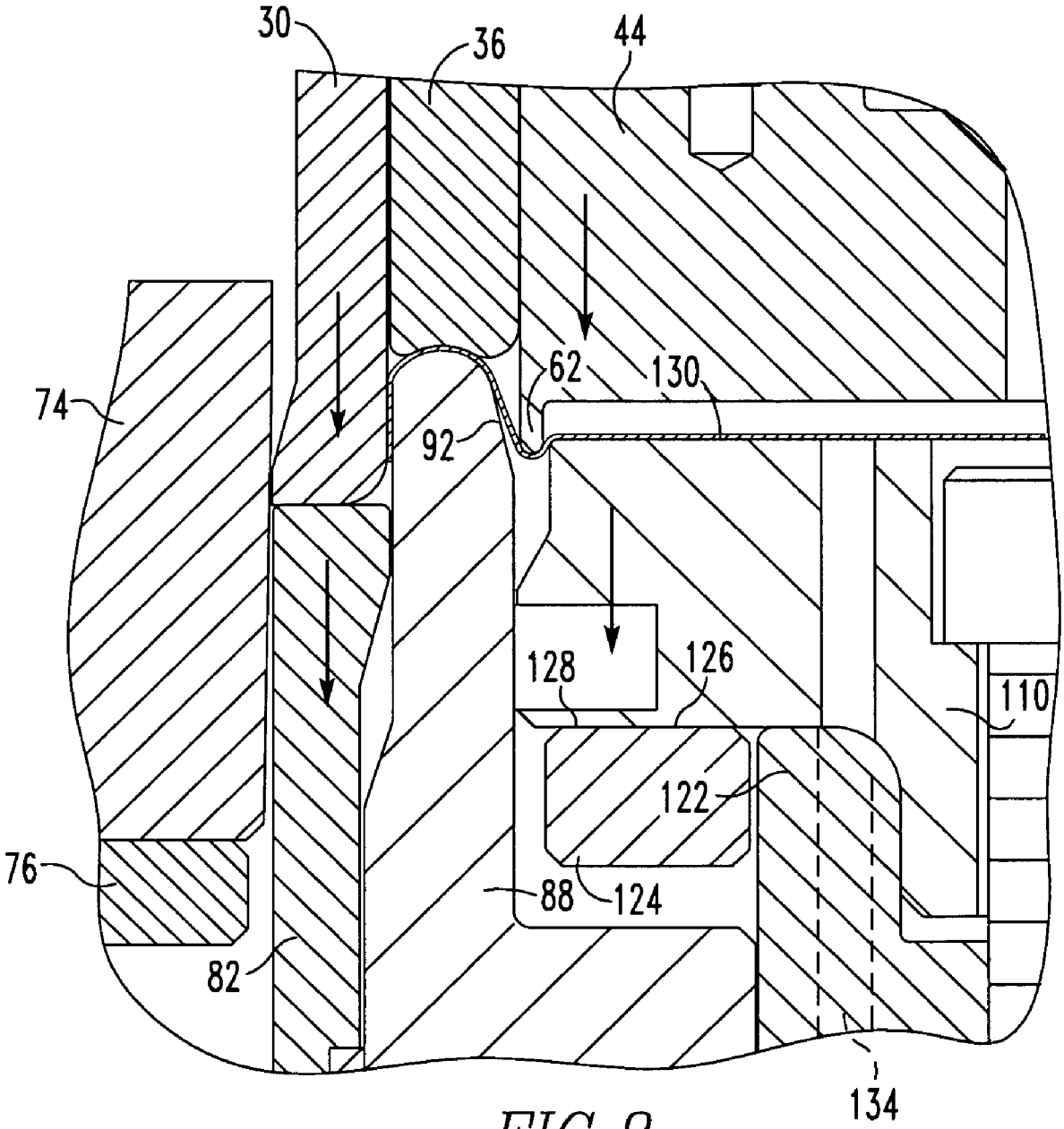
Figure 9:
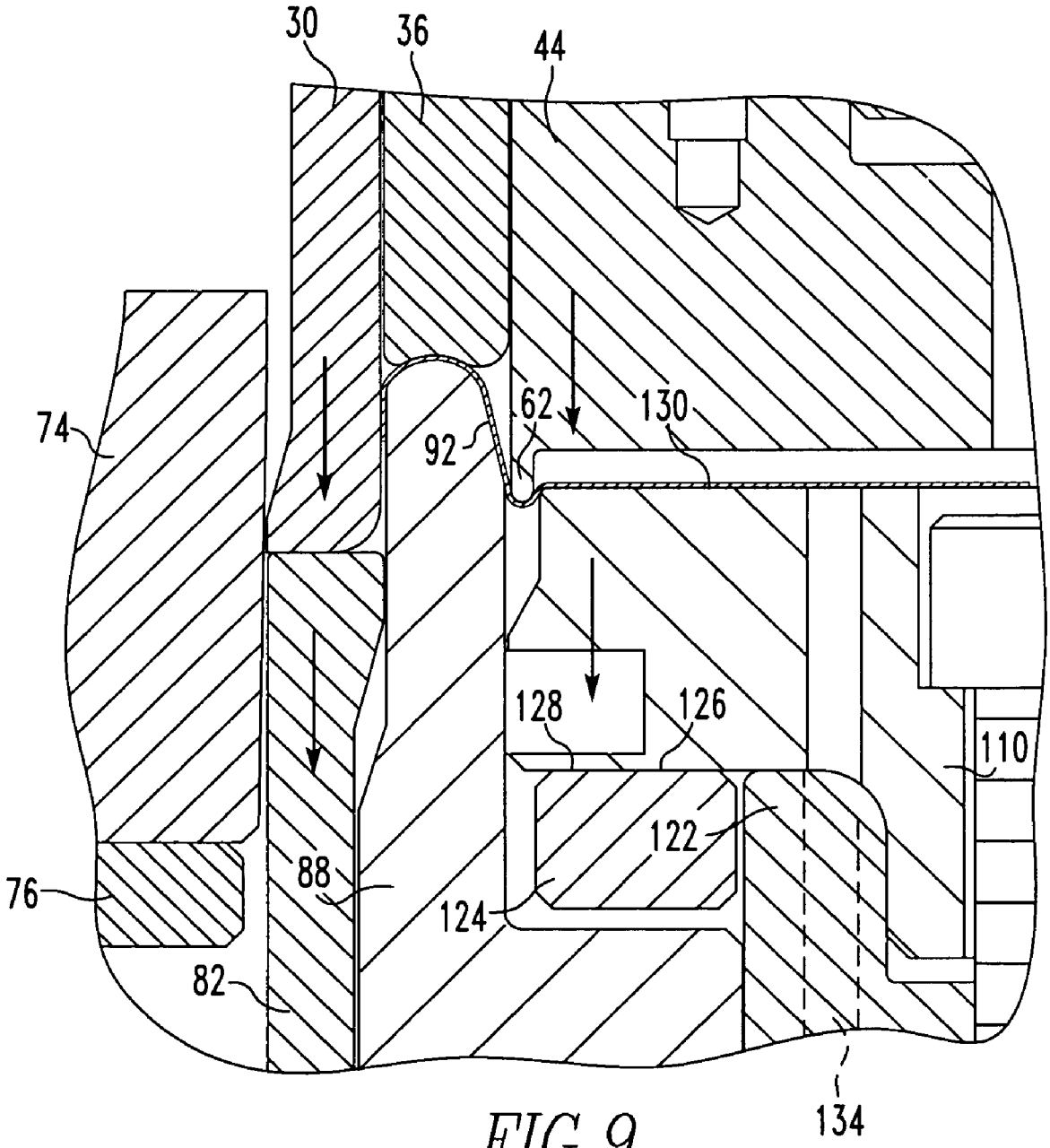

The operation of the tooling system or assembly 24 couple to a press for forming shells 10, is now described in connection with FIGS. 1-15. As shown in FIGS. 2-3, a continuous strip of material or metal sheet 136 of aluminum alloyed sheet having a thickness of about 0.0088 inch (0.022 cm), is fed on a stock plate (not shown) across the cut edge die 74 and below a stripper plate (not shown). The material or metal sheet 136 is moved between the upper die shoe 26 and the lower die shoe 28. When the upper die shoe 26 moves downwardly, the mating cutting edges 56 and 80 (FIG. 3) blank the material to form a blank 138 (FIG. 4). As the blank and draw die 30 continues to move downwardly (FIG. 4), a peripheral edge portion 140 of the blank 138 is confined between the blank and draw die 30 and the upper surface 86 of the lower pressure sleeve 82. As the upper pressure sleeve 36 moves downwardly with the blank and draw die 30 (FIG. 4), an annular intermediate portion 142 of the blank 138 begins to wrap around the peripheral surface 132 of the panel punch 110. The peripheral edge portion 140 is coupled to a raised center panel portion 141 which is formed. The raised center panel portion 141 is located above or at a higher point than the peripheral edge portion 140. The peripheral edge portion 140 is located below or at a lower point than the raised center panel portion 141. The gas pressure below the lower pressure sleeve 82 is selected to produce a predetermined clamping or gripping pressure against the peripheral edge portion 140 of the blank 138 and to allow the peripheral edge portion 140 to slide radially inwardly between the blank and draw die 30 and the lower pressure sleeve 82, as shown in FIGS. 4-6.

As the blank and draw die 30 and upper pressure sleeve 36 continue to move downwardly (FIG. 5), an inner part of the intermediate portion 142 of the blank 138 forms into a frustoconical portion 144, and that portion 144 starts to wrap around the slightly rounded peripheral surface 132 of the panel punch 110 so that the raised center panel portion 141 is defined on top of the panel punch 110. As a result of a small clearance of less than 0.005 inch (0.013 cm) and about 0.001 inch to 0.002 inch (0.003 cm to 0.005 cm) over metal thickness between the outer cylindrical surface of the panel punch 110 and the inner cylindrical surface of the nose portion 62 of the die center 44, or as a result of an interference fit, as will be explained later, the raised center panel portion 141 does not continue further into the cavity 60.

As the die center 44 and panel punch move further downwardly with the blank and draw die 30 (FIGS. 6-10), the material wraps around the downwardly projecting nose portion 62 of the die center 44 and slides down the tapered surface 92 of the die core ring 88 and slides between the upper pressure sleeve 36 and the die core ring 88 and between the blank and draw die 30 and the lower pressure sleeve 82 to form the crown 20, peripheral curl 22 and chuck wall 18 of the shell 10.

Figure 10:
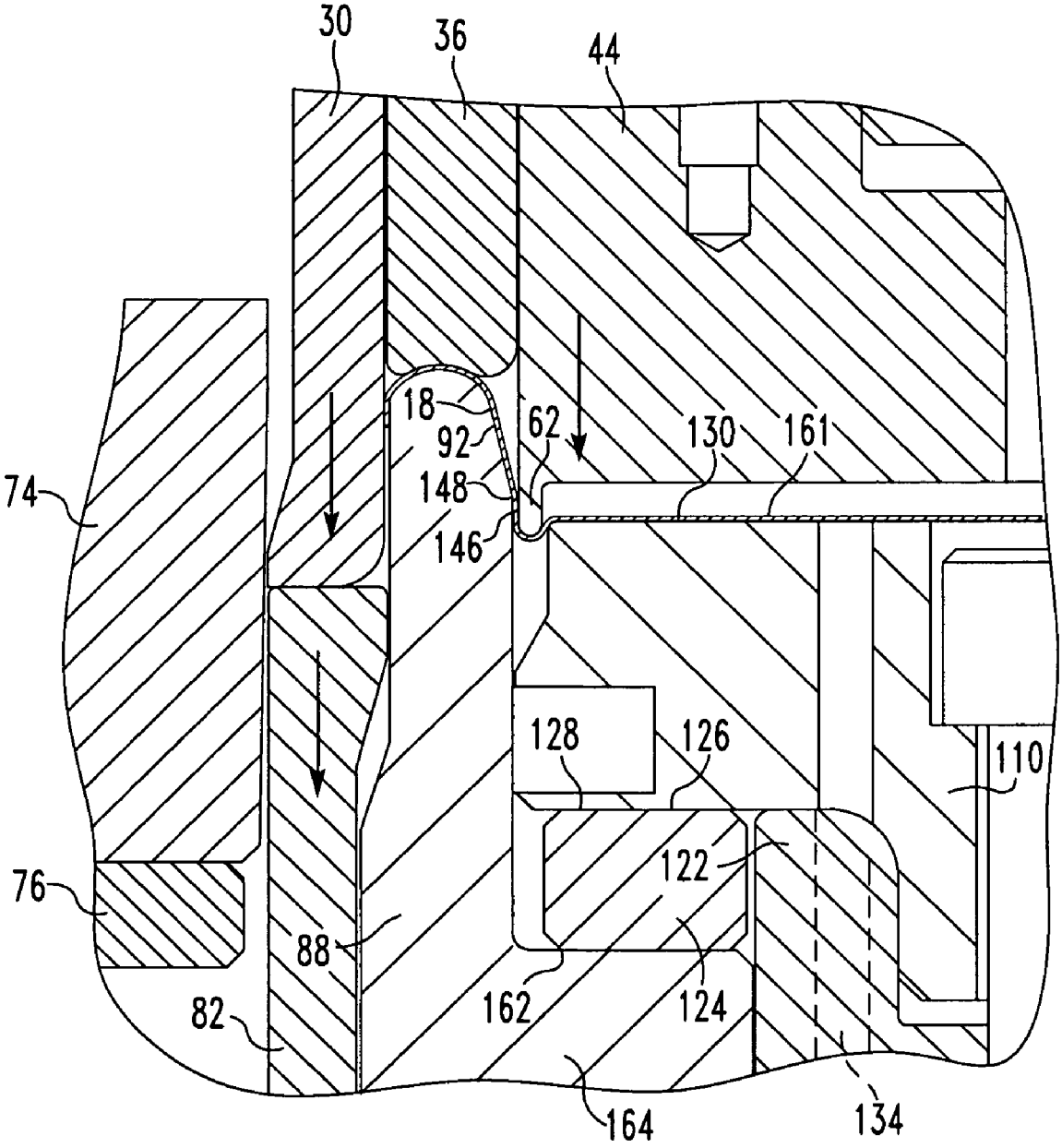
Figure 11:
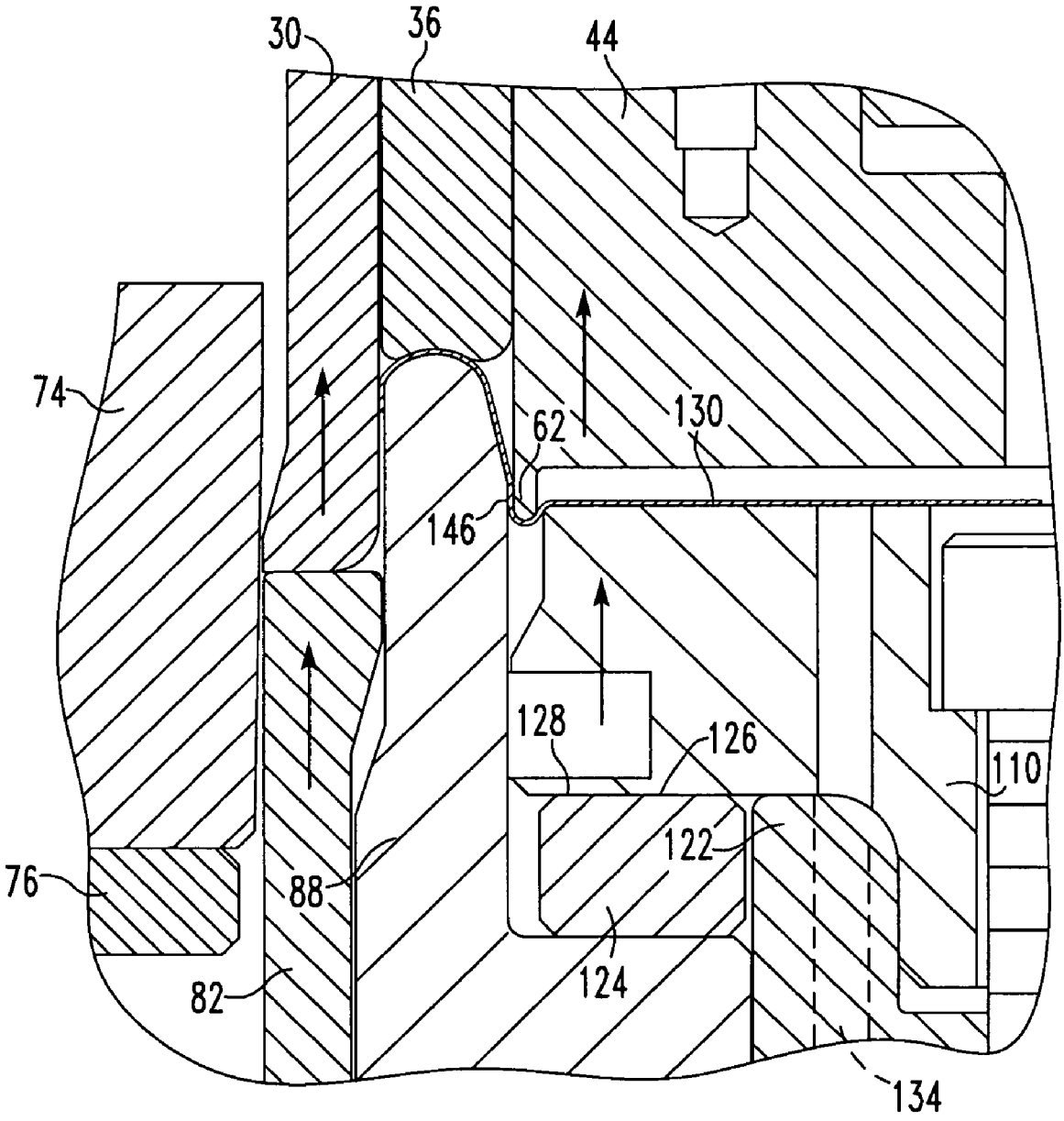
Figure 12:
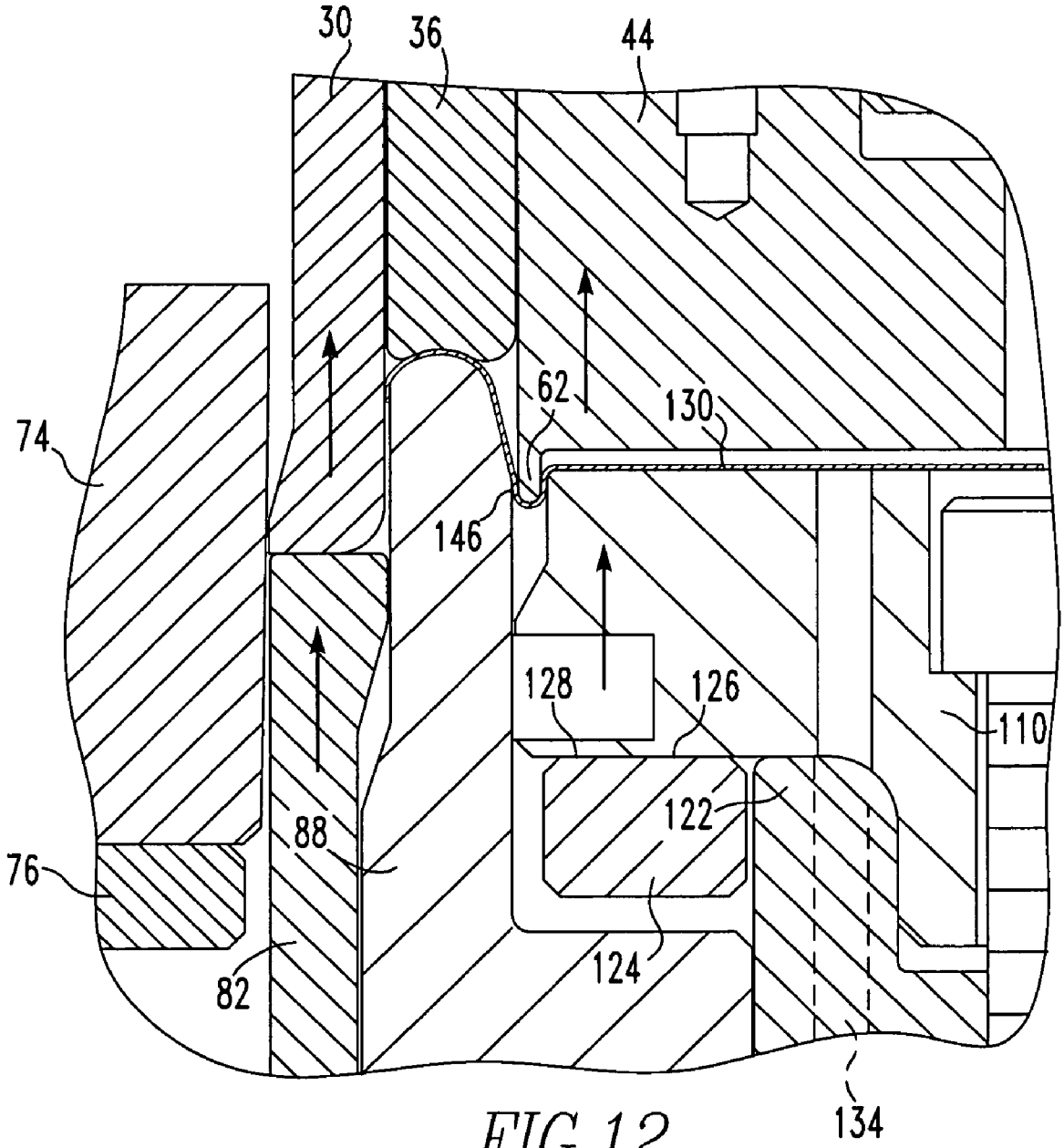

As shown in FIG. 10, as a result of the further downward movement of the die center 44 and the small clearance of less than 0.005 inch (0.013 cm) and about 0.001 inch to 0.002 inch (0.003 cm to 0.005 cm) between the outer cylindrical surface of the nose portion 62 and the inner cylindrical surface 98 of the die core ring 88, the chuck wall 18 continues further downwardly to form a cylindrical portion 146 which cooperates with the chuck wall 18 to form an annular bow or ridge 148 within the chuck wall 18 when the die center 44 and panel punch 110 bottom at their closed positions.

Figure 13:
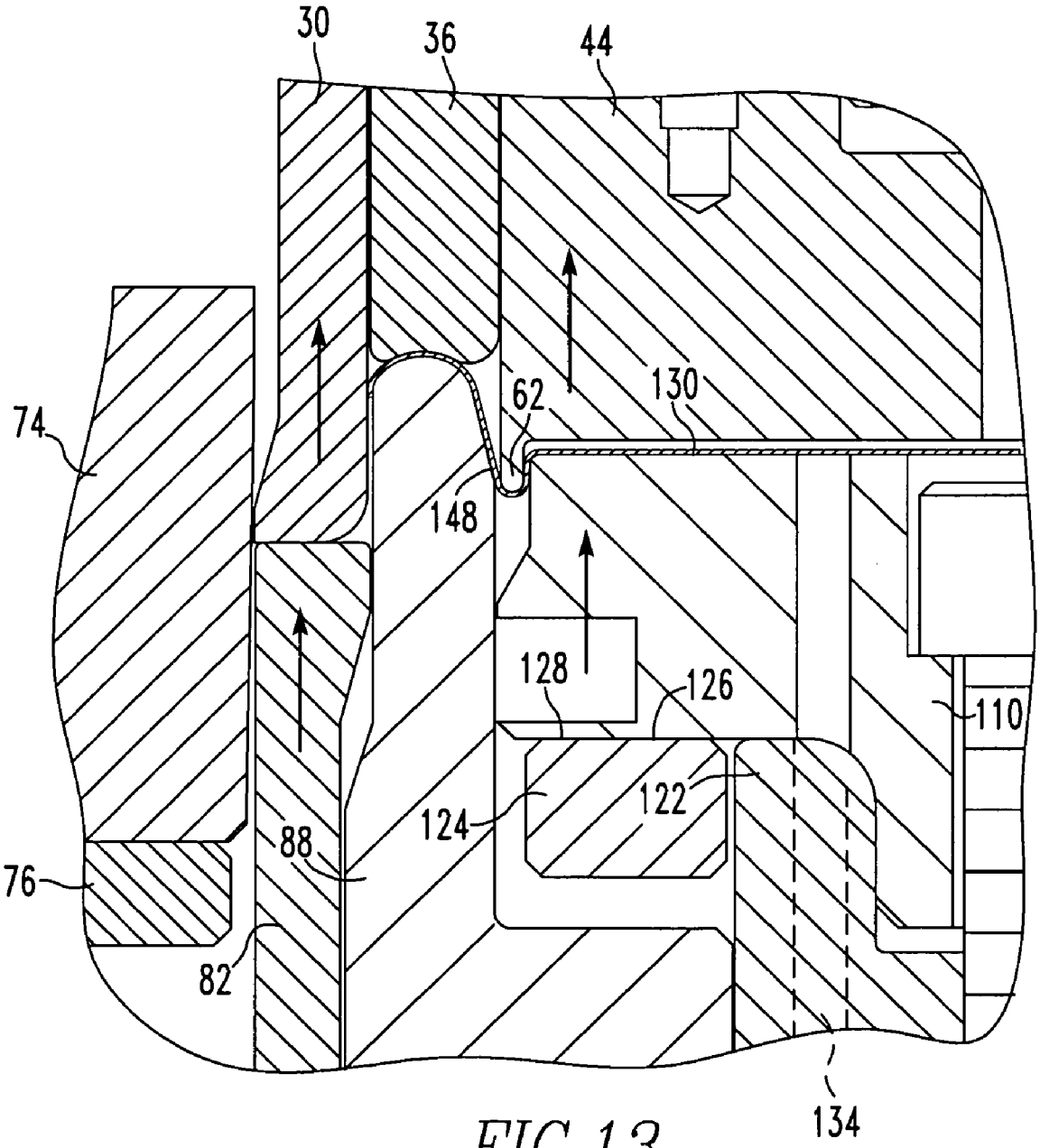

Referring to FIGS. 1 and 11-13, as the upper die shoe 26 and the die center 44 reverse and move upwardly, the metal forming the cylindrical portion 146 rolls around the nose portion 62 of the die center 44, and the upward pressure on the panel punch 10 moves the center panel 12 upwardly within the cavity 60 until the center panel 12 engages the bottom surface of the die center 44. The radial space between the outer cylindrical surface of the panel punch 110 and the inner cylindrical surface of the nose portion 62 may be between 0.0005 inch to 0.0015 inch (0.001 cm to 0.004 cm) less than the metal sheet 136 thickness. As the metal rolls around the nose portion 62 of the die center 44, the cylindrical panel wall portion 14 is ironed or coined between the outer surface of the panel punch 110 and the inner surface of the nose portion 62 to form a reduced wall thickness. As can be seen in FIG. 13, after the panel wall 14 and countersink 16 are formed, the chuck wall 18 still includes the inwardly projecting annular bow or ridge 148.

After a shell 10 is formed (FIG. 1) and the upper die shoe 26 is moving upwardly, the shell 10 is retained by friction within the blank and draw die 30. The center panel 12 is located below or at a lower point than the crown 20. The crown 20 is located above or at a higher point than the center panel 12. The shell 10 is released from the die center 44 by downward movement of the upper pressure sleeve 36 and gas supplied through passages 134. While the upper die shoe 26 is moving upwardly, pressurized jets of gas are directed upwardly from the passages 134 so the shell 10 is held against the bottom surface of the upper pressure sleeve 36. When the blank and draw die 30 arrive at a predetermined elevation and the panel punch piston 112 stops upward movement within the die core ring 88, the upper pressure sleeve 36 and shell 10 are shifted downwardly to the starting position, and the shell 10 is released by the passages 134 so that the shell 10 is free for lateral ejection or discharge into a guide chute (not shown) by a jet of gas from a nozzle (not shown) connected to a pressurized gas supply.

Figure 14:
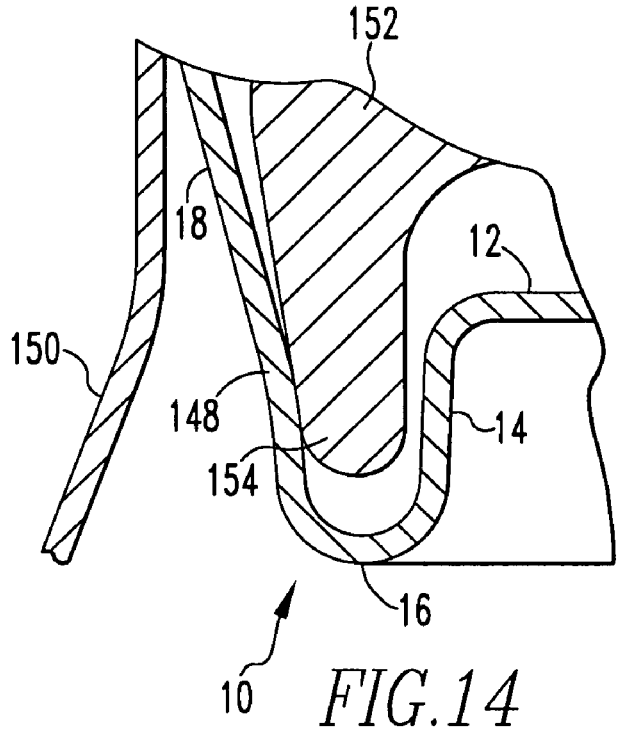
FIGS. 14-15 are cross-sectional views of the shell shown in FIG. 1 and illustrating a subsequent step of deforming the shell while it is being seamed to a can.
Figure 15:
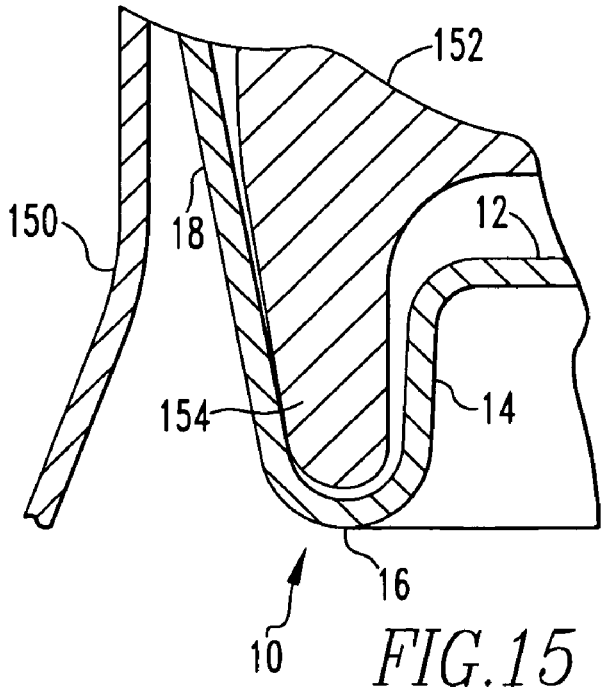

Referring to FIGS. 14-15, when the shell 10 is being attached to the neck or upper end 150 of a can by a seamer machine, a seamer chuck 152 with a depending annular nose portion 154 is brought into engagement with the shell 10 so that the seamer chuck 152 engages the inwardly projecting bow or ridge portion 148 of the chuck wall 18. The nose portion 154 presses radially outwardly on the ridge portion 148 so that the chuck wall 18 becomes substantially straight in axial cross-section (FIG. 15), and the ironed panel wall 14 moves to a cylindrical configuration (FIG. 15) to obtain the maximum strength/weight ratio for the shell 10.

The die center riser 46 has an upper piston portion 156 and includes a stepped head portion 158 which is slidably supported within the riser body 32. The die center riser 46 also has an outwardly projecting shoulder 160. The pressurized gas for the chamber 40 above the upper pressure sleeve 36 is received through passage 66 connected to a suitable pressurized gas supply line (not shown). In operation, when the upper die shoe 26 and associated tooling assembly has reached the bottom of its stroke, the blank and draw die 30, the upper pressure sleeve 36 and the die center 44 are in their lowermost positions as is shown in FIG. 10. At the bottom of the stroke of the press and the tooling assembly 24, the shoulder 160 of the die center riser 46 is in engagement with and forms a stop for the upper piston portion 38 of the upper pressure sleeve 36 as a result of the selected gas pressures within the chamber 40 and above the upper piston portion 156. The height between the lower end of the die center nose portion 62 and the lower end of the upper pressure sleeve 36 is precisely established by the stop.

In certain applications, it has been determined that the pre-panel of the shell formed in the downstroke of a press does not form to the same depth on each stroke of a tooling assembly. The pre-panel not forming to the same depth on each stroke of the tooling assembly may be caused by variations in press speed, metallurgical properties of the shell material, differences in material coatings and surface lubrication, and/or tooling tolerances. The spacer member 124 provides the pre-panel 161 (FIG. 10) of the shell 10 being formed in FIGS. 4-10 with a consistent depth. The spacer 124 allows the pre-panel 161 being formed into the shell 10 on the downstroke of the tooling assembly 24 coupled to the press to be the same depth across the die set from press stroke to press stroke regardless of the variables listed above. Consistent depth of the pre-panel 161 formed in the downstroke of the tooling assembly 24 of the press will result in unit depth dimensions of the shell 10 to be held to about ±0.0005 inch (0.001 cm).

At the bottom of the stroke of the tooling assembly 24, the shoulder 160 on the die center riser 46 is in engagement with and forms a stop for the upper piston portion 38 of the upper pressure sleeve 36 as a result of the selected gas pressures within the chamber 40 and above the upper piston portion 156. The engagement of the shoulder 160 with the upper piston portion 38 of the upper pressure sleeve 36 controls the movement of the die center 44 and the upper pressure sleeve 36. Also, as is shown in FIG. 10, at the bottom of the stroke of the tooling assembly 24, a lower end 162 of the spacer 124 comes into engagement with a radially extending shoulder portion 164 of the die core ring 88. The tooling assembly 24 uses the upper piston portion 38 to control the amount of penetration of the die center 44 into the die core ring 88. With the depth of the pre-panel 161 controlled at the bottom of the tooling stroke, the pre-panel 161 of the shell 10 is also controlled by bottoming the spacer member 124 on the shoulder 164 of the die core ring 88. The spacer member 124 controls the movement of the panel punch 110 by spacing the movement of the panel punch 110 from the shoulder 164 of the die core ring 88. The spacer member 124 prevents the lower end 128 of the panel punch 110 from engaging the shoulder 164 of the die core ring 88. Controlling the depth of the pre-panel 161 of the shell 10 to a predetermined dimension allows for the center panel 12 of the shell to roll-up into the cavity 60 the same amount on each stroke of the press.

As a result, the upper tooling shown in FIG. 2 and the lower tooling shown in FIG. 10 produces a shell 10 which has a precise unit depth from the bottom of the countersink 16 (FIG. 1) to the bottom of the crown 20. Furthermore, this precise depth is maintained or remains constant during high speed operation of the press and tooling assembly 24 after arriving at operating temperature as well as during start up of the press and before the press changes due to thermal expansion and operational dynamics. The combination of the upper tooling shown in FIG. 2 and the lower tooling shown in FIG. 10 provides several desirable characteristics in the manufacture of shells.

For example, the invention provides dimensional stability of the shell. Shells are statistically centered within the specifications of an end user. The tooling assembly 24 could be used to form shells from lubricated and non-lubricated metal sheet without tooling stack height changes. Shell bagging is also improved due to dimensional stability of the shell.

The tooling assembly 24 is adapted for use on a single action press with each shell being completely formed at a single tooling station without any significant thinning of the sheet material. The tooling assembly 24 also provides for producing the strongest shell from the thinnest gauge material for obtaining more economical production of shells. The tooling assembly 24 enables a significant reduction in metal sheet thickness while increasing the strength of the shell to withstand substantial pressure within the rigid can without buckling or deforming the shell.

More specifically, the panel wall radius 14 and the countersink 16 radius may be minimized by rolling of the material around the nose portion 62 and between the nose portion 62 and the closely spaced panel punch 110 while the die center 44 and the panel punch 110 are moving upwardly. The capability to produce these minimum radiuses and the ironing or coining of the panel wall 14 provides for increasing the axial strength of the cylindrical panel wall 14 and to move metal into the panel wall 14 radius, thereby increasing the strength of the shell 10 against buckling. Also, the formation of the panel wall 14 and the countersink 16 in this manner around and within the nose portion 62 provides for a precision and uniform countersink 16 radius and avoids stretching and thinning of the thin metal sheet around the panel wall 14 radius and the countersink 16 radius so that a thinner gauge metal sheet can be used.

The small clearance over metal thickness between the nose portion 62 and the inner cylindrical surface 94 of the die core ring 88 provides for producing the bow or ridge 148 within the chuck wall 18. This reinforces the chuck wall 18 and permits shifting the panel wall 14 to a precisely vertical or cylindrical configuration by the subsequent operation during seaming, as shown in FIGS. 14-15.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereof.

What is claimed is:

1. A tooling assembly for forming a shell having a preselected depth, the tooling assembly comprising:

a die center;

a panel punch located in opposed relation to the die center;

a panel punch piston coupled to the panel punch, the panel punch piston having an upper end; and a spacer member disposed concentrically around an outside surface of the panel punch piston at or proximate to the upper end of the panel punch piston, wherein an upper end of the spacer member is in contact with a lower end of the panel punch and the spacer member is located proximate to a peripheral surface of the lower end of the panel punch, wherein the tooling assembly is movable between a first position in which a lower end of the spacer member is structured to be spaced apart from an opposing portion of the tooling assembly, and a second position in which the lower end of the spacer member is structured to engage the opposing portion of the tooling assembly, thereby establishing the preselected depth of the shell, and wherein the second position in which the preselected depth of the shell is established corresponds to a bottom of a stroke of the tooling assembly.

2. The tooling assembly of claim 1, further comprising a die core ring having a shoulder, wherein when the tool assembly is not at the bottom of the stroke, the lower end of the spacer member is structured to be spaced apart from the shoulder of the die core ring, and wherein the lower end of the spacer member is structured to engage the shoulder of the die core ring at the bottom of the stroke of the tooling assembly.

3. The tooling assembly of claim 1, further comprising an upper pressure sleeve having an upper piston portion, wherein the die center is coupled to a die center riser having a shoulder, and wherein the shoulder of the die center riser is structured to engage the upper piston portion of the upper pressure sleeve at a bottom of a stroke of the tooling assembly.

4. The tooling assembly of claim 2, further comprising an upper pressure sleeve having an upper piston portion, wherein the die center is coupled to a die center riser having a shoulder, and wherein the shoulder of the die center riser is structured to engage the upper piston portion of the upper pressure sleeve at a bottom of a stroke of the tooling assembly.

5. The tooling assembly of claim 1, wherein the tooling assembly is structured to form shells with a generally uniform depth.

6. An apparatus for forming a shell having a preselected depth, the apparatus comprising:

a die center;

an upper pressure sleeve located proximate to the die center;

a blank and draw die located proximate to the upper pressure sleeve;

a panel punch located in opposed relation to the die center;

a die core ring having an upper end with the upper end of the die core ring located proximate to the panel punch and in opposed relation to a lower end of the upper pressure sleeve;

a lower pressure sleeve having an upper end with the upper end of the lower pressure sleeve located proximate to the die core ring and in opposed relation to a lower end of the blank and draw die;

a blank cutedge located proximate to the lower pressure sleeve;

a panel punch piston coupled to the panel punch, the panel punch piston having an upper end; and a spacer member disposed concentrically around an outside surface of the panel punch piston at or proximate to the upper end of the panel punch piston, wherein an upper end of the spacer member is in contact with a lower end of the panel punch and the spacer member is located proximate to a peripheral surface of the lower end of the panel punch, wherein the apparatus is movable between a first position in which a lower end of the spacer member is structured to be spaced apart from an opposing portion of the apparatus, and a second position in which the lower end of the spacer member is structured to engage the opposing portion of the apparatus, thereby establishing the preselected depth of the shell, and wherein the second position in which the preselected depth of the shell is established corresponds to a bottom of a stroke of the apparatus.

7. The apparatus of claim 6, wherein the die core ring has a shoulder and wherein when the apparatus is not at the bottom of the stroke, the lower end of the spacer member is structured to be spaced apart from the shoulder of the die core ring, and wherein the lower end of the spacer member is structured to engage the shoulder of the die core ring at the bottom of the stroke of the apparatus.

8. The apparatus of claim 6, wherein the die center is coupled to a die center riser having a shoulder, wherein the upper pressure sleeve has an upper piston portion, and wherein the shoulder of the die center riser is structured to engage the upper piston portion of the upper pressure sleeve at a bottom of a stroke of the apparatus.

9. The apparatus of claim 7, wherein the die center is coupled to a die center riser having a shoulder, wherein the upper pressure sleeve has an upper piston portion, and wherein the shoulder of the die center riser is structured to engage the upper piston portion of the upper pressure sleeve at a bottom of a stroke of the apparatus.

10. The apparatus of claim 6, wherein the apparatus is structured to form shells with a generally uniform depth.

11. A method for forming a shell having a preselected depth, the method comprising:

moving material between an upper die shoe and a lower die shoe;

blanking the material to form a blank;

forming the blank to provide a peripheral edge portion coupled to a raised center panel portion with the raised central panel portion located above the peripheral edge portion;

forming the blank into a shell with a center panel coupled to a crown with the crown located above the center panel location;

controlling movement of a panel punch by spacing the movement of the panel punch from a shoulder of a die core ring;

preventing engagement of a lower end of the panel punch with the shoulder of the die core ring using a spacer member disposed between the lower end of the panel punch and the shoulder of the die core ring, the spacer member having an upper end contacting the lower end of the panel punch, and an opposing lower end facing the shoulder of the die core ring, moving the panel punch between a first position in which the lower end of the spacer member is spaced apart from the shoulder of the die core ring, and a second position in which the lower end of the spacer member engages the shoulder of the die core ring, the second position corresponding to a bottom of a stroke of the panel punch, and establishing the preselected depth of the shell at the bottom of the stroke of the panel punch.

12. The method of claim 11, further comprising controlling movement of a die center and an upper pressure sleeve by engaging a shoulder of a die center riser coupled to the die center with an upper piston portion of the upper pressure sleeve.

13. The method of claim 11, wherein the upper die shoe includes tooling comprising:

a die center;

an upper pressure sleeve located proximate to the die center; and a blank and draw die located proximate to the upper pressure sleeve, and wherein the lower die shoe includes tooling comprising:

the panel punch located in opposed relation to the die center;

the die core ring having an upper end with the upper end of the die core ring located proximate to the panel punch and in opposed relation to a lower end of the upper pressure sleeve;

a lower pressure sleeve having an upper end with the upper end of the lower pressure sleeve located proximate to the die core ring and in opposed relation to a lower end of the blank and draw die;

a blank cutedge located proximate to the lower pressure sleeve; and a panel punch piston coupled to the panel punch, the panel punch piston having an upper end;

wherein the spacer member is disposed concentrically around an outside surface of the panel punch piston at or proximate to the upper end of the panel punch piston, and wherein an upper end of the spacer member is in contact with a lower end of the panel punch and the spacer member is located proximate to a peripheral surface of the lower end of the panel punch.

14. The method of claim 13, wherein when the panel punch is not at the bottom of the stroke, a lower end of the spacer member is structured to be spaced apart from the shoulder of the die core ring, and wherein the lower end of the spacer member is structured to engage the shoulder of the die core ring at the bottom of the stroke of the panel punch.

15. The method of claim 13, wherein the die center is coupled to a die center riser having a shoulder, wherein the upper pressure sleeve has an upper piston portion, and wherein the shoulder of the die center riser is structured to engage the upper piston portion of the upper pressure sleeve at a bottom of a stroke of a tooling assembly.

16. The method of claim 14, wherein the die center is coupled to a die center riser having a shoulder, wherein the upper pressure sleeve has an upper piston portion, and wherein the shoulder of the die center riser is structured to engage the upper piston portion of the upper pressure sleeve at a bottom of a stroke of the tooling assembly.

17. The method of claim 11, wherein the shell forming step forms shells with a generally uniform depth.

18. The tooling assembly of claim 1 wherein the shell comprises a center panel, an annular countersink extending around the center panel, a crown and a tapered chuck wall connecting the countersink to the crown; and wherein the shell is devoid of a z-fold between the center panel and the chuck wall.

19. The apparatus of claim 6 wherein the shell comprises a center panel, an annular countersink extending around the center panel, a crown and a tapered chuck wall connecting the countersink to the crown; and wherein the shell is devoid of a z-fold between the center panel and the chuck wall.

20. The method of claim 11 wherein the shell comprises a center panel, an annular countersink extending around the center panel, a crown and a tapered chuck wall connecting the countersink to the crown; and wherein the shell is devoid of a z-fold between the center panel and the chuck wall.

* * * * *

UNITED STATES PATENT AND TRADEMARK OFFICE

CERTIFICATE OF CORRECTION

PATENT NO. : 7,478,550 B2
APPLICATION NO. : 11/655602
DATED : January 20, 2009
INVENTOR(S) : David Keith Wynn et al.

It is certified that error appears in the above-identified patent and that said Letters Patent is hereby corrected as shown below:

Column 6, line 28, "punch 10 moves" should be --punch 110 moves--.

Signed and Sealed this

Eighteenth Day of August, 2009

David J. Kappos

David J. Kappos
*Director of the United States Patent and Trademark Office*